US008055181B2

(12) United States Patent
Murayama

(10) Patent No.: US 8,055,181 B2
(45) Date of Patent: Nov. 8, 2011

(54) IMAGE FORMING APPARATUS

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 917 days.

(21) Appl. No.: 11/965,298

(22) Filed: Dec. 27, 2007

(65) Prior Publication Data

US 2008/0175638 A1 Jul. 24, 2008

(30) Foreign Application Priority Data

Dec. 27, 2006 (JP) ..... 2006-351660

(51) Int. Cl.
*G03G 15/00* (2006.01)

(52) U.S. Cl. ..... 399/401; 399/405

(58) Field of Classification Search ..... 101/401; 399/401

See application file for complete search history.

(56) References Cited

U.S. PATENT DOCUMENTS

| | | | | |
|---|---|---|---|---|
| 4,884,110 | A * | 11/1989 | Tsurubuchi et al. | 399/402 |
| 5,780,954 | A * | 7/1998 | Davis | 310/306 |
| 5,857,137 | A * | 1/1999 | Sakata et al. | 399/402 |
| 5,927,702 | A * | 7/1999 | Ishii et al. | 271/9.09 |
| 6,398,214 | B1 * | 6/2002 | Moteki et al. | 271/220 |
| 6,427,997 | B1 * | 8/2002 | Hirota et al. | 270/58.12 |
| 6,568,668 | B1 * | 5/2003 | Wakabayashi et al. | 270/58.11 |
| 6,717,286 | B2 * | 4/2004 | Tsuchiya et al. | 270/58.07 |
| 7,450,279 | B2 * | 11/2008 | Hiromatsu et al. | 358/505 |
| 2002/0089111 | A1 * | 7/2002 | Tsuchiya et al. | 270/58.08 |
| 2003/0178764 | A1 * | 9/2003 | Hasegawa | 271/171 |
| 2003/0209848 | A1 * | 11/2003 | Hasegawa | 271/3.14 |

FOREIGN PATENT DOCUMENTS

| | | |
|---|---|---|
| JP | 61-075745 | 4/1986 |
| JP | 06-056356 | 3/1994 |
| JP | 2002-104694 | 4/2002 |
| JP | 2003-063694 | 3/2003 |
| JP | 2004-029289 | 1/2004 |
| JP | 2005-263436 | 9/2005 |
| JP | 3890874 | 12/2006 |

OTHER PUBLICATIONS

Office Action received for corresponding Japanese Application No. 2006-351660 mailed May 10, 2011.

* cited by examiner

*Primary Examiner* — Anthony H. Nguyen
(74) *Attorney, Agent, or Firm* — Banner & Witcoff, Ltd.

(57) ABSTRACT

An image forming apparatus for preventing sheet jams and displacement of image formation when forming images on both front and rear sides is provided. The apparatus includes first and second width regulation mechanisms, a reverse transport mechanism and a link mechanism. The first width regulation mechanism is provided within a sheet holding chamber, and is movable with respect to a center of an image formation range of an image forming unit. The reverse transport mechanism is configured to turn the sheet from a first side to a second side upon the first side passing through the image forming unit. The second width regulation mechanism, provided within the reverse transport mechanism, is movable in the width direction. The link mechanism is provided between the first and second width regulation mechanisms for changing a position of the second width regulation mechanism in association with position change of the first width regulation mechanism.

10 Claims, 11 Drawing Sheets

IMAGE FORMING APPARATUS

CROSS-REFERENCE TO RELATED APPLICATION

This application claims the benefit of Japanese Patent Application No. 2006-351660 filed on Dec. 27, 2006, which is incorporated herein by reference.

BACKGROUND

The present invention relates to an image forming apparatus.

A conventional image forming apparatus is disclosed in JP-A-2002-104694. The image forming apparatus has a housing, a sheet feed cassette, an image forming unit, a first width regulation mechanism, a reverse transport mechanism, and a second width regulation mechanism.

The sheet feed cassette has a sheet holding chamber for holding stacked sheets of paper, and can be housed within and drawn from the housing. The image forming unit is provided within the housing for forming images on sheets transported from the sheet holding chamber of the sheet feed cassette. The first width regulation mechanism is provided within the sheet holding chamber, movable with the center of an image formation range of the image forming unit as a reference position, and positioned according to the sheet width. The reverse transport mechanism is provided within the housing for turning over the sheet that has passed through the image forming unit and transporting the sheet to the image forming unit again. The second width regulation mechanism is provided within the reverse transport mechanism, movable in the width direction, and positioned according to the sheet width.

The first width regulation mechanism and the second width regulation mechanism are respectively independent, and their positions are separately changed by hand. Especially, the position of the second width regulation mechanism is changed by manually swinging a lever provided at the opposite side to the side of the housing at which the sheet feed cassette is housed.

In the conventional image forming apparatus having the above described configuration, the first width regulation mechanism regulates the position of the sheet in the width direction so that the sheet may be transported into the image formation range within the sheet holding chamber. Thereby, the image forming apparatus transports the sheet without displacement relative to the image formation range of the image forming unit and forms an image on the front side thereof. Then, the image forming apparatus ejects the sheet with the image formed on the front side from the housing to the outside, or transports the sheet to the reverse transport mechanism for image formation on the rear side.

Then, when the sheet is transported to the reverse transport mechanism, the sheet is turned over within the reverse transport mechanism, and further, the second width regulation mechanism regulates the position of the sheet in the width direction so that the sheet may be transported into the image formation range again. Thereby, the image forming apparatus transports the sheet without displacement relative to the image formation range of the image forming unit again and forms an image on the rear side thereof. Then, the image forming apparatus ejects the sheet with the images formed on both the front side and the rear side from the housing to the outside.

In this manner, the conventional image forming apparatus can form images only on the front side or both front and rear sides of a sheet.

SUMMARY

However, in the conventional image forming apparatus, the first width regulation mechanism and the second width regulation mechanism are respectively independent and separately adjusted by hand, and thus, the following problems may occur.

When a user replaces sheets in a different size in the sheet holding chamber, the user changes the position of the first width regulation mechanism according to the sheet width, but may forget about changing the position of the second width regulation mechanism. Especially, when the user changes the position of the second width regulation mechanism, it is necessary for the user to manually swing the lever provided at the opposite side to the side of the housing at which the sheet feed cassette is housed, unlike the first width regulation mechanism that is located near the user when replacing the sheets. For this reason, the user tends to forget about changing the position of the second width regulation mechanism. When the difference between sizes is small as in the case where A4-sized sheets are replaced by letter-sized sheets, the tendency is remarkable.

As described above, when the user forgets about changing the position of the second width regulation mechanism, the position of the first width regulation mechanism and the position of the second width regulation mechanism are not matched. Thus, when images are formed on both front and rear sides, the problems that the sheet is jammed within the reverse transport mechanism and the sheet is transported into the image forming unit with displacement relative to the image formation range and the image formation is displaced will occur.

The invention has been achieved in view of the above described conventional circumstances, and a purpose of the invention is to provide an image forming apparatus that can prevent sheet jams and displacement in image information when images are formed on both front and rear sides.

An image forming apparatus of the invention includes a housing, a sheet feed cassette, an image forming unit, a first width regulation mechanism, a reverse transport mechanism, a second width regulation mechanism, and a link mechanism. The sheet feed cassette has a sheet holding chamber for holding stacked sheets, and can be housed within and drawn from the housing. The image forming unit is provided within the housing for performing image formation on the sheet to be transported. The first width regulation mechanism is provided within the sheet holding chamber, movable with a center of an image formation range of the image forming unit as a reference position, and positioned according to a sheet width. The reverse transport mechanism is provided within the housing for turning over the sheet that has passed through the image forming unit and transporting the sheet to the image forming unit again. The second width regulation mechanism is provided within the reverse transport mechanism, movable in the width direction, and positioned according to the sheet width. The link mechanism is provided between the first width regulation mechanism and the second width regulation mechanism for mechanically changing a position of the second width regulation mechanism in association with position change of the first width regulation mechanism.

In the image forming apparatus of the invention having such a configuration, the link mechanism mechanically changes the position of the second width regulation mechanism in association with the position change of the first width regulation mechanism. Accordingly, unlike the conventional image forming apparatus, the error that a user changes the position of the first width regulation mechanism according to the width of sheets placed in the sheet feed cassette, but forgets about changing the position of the second width regulation mechanism hardly occurs. Therefore, the position of the first width regulation mechanism and the position of the second width regulation mechanism are constantly matched.

Thus, the image forming apparatus of the invention can prevent sheet jams and displacement of image formation when images are formed on both front and rear sides.

BRIEF DESCRIPTION OF THE SEVERAL VIEWS OF THE DRAWINGS

Hereinafter, embodiments 1, 2 that embody the invention will be described with reference to the drawings.

DETAILED DESCRIPTION OF THE PREFERRED EMBODIMENTS

Embodiment 1

Figure 1:
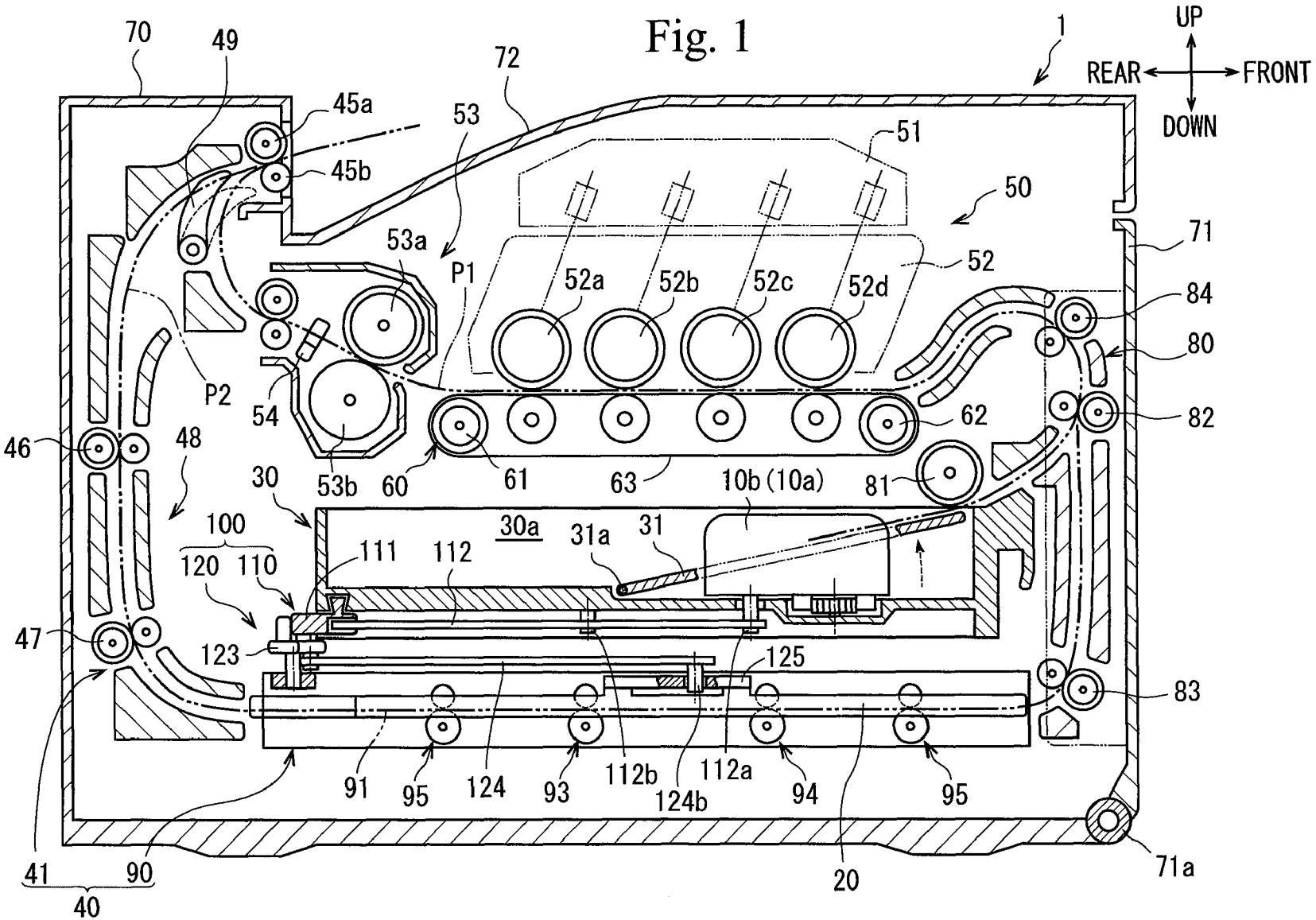
FIG. 1 is a schematic sectional view of a printer of embodiment 1.
Figure 2:
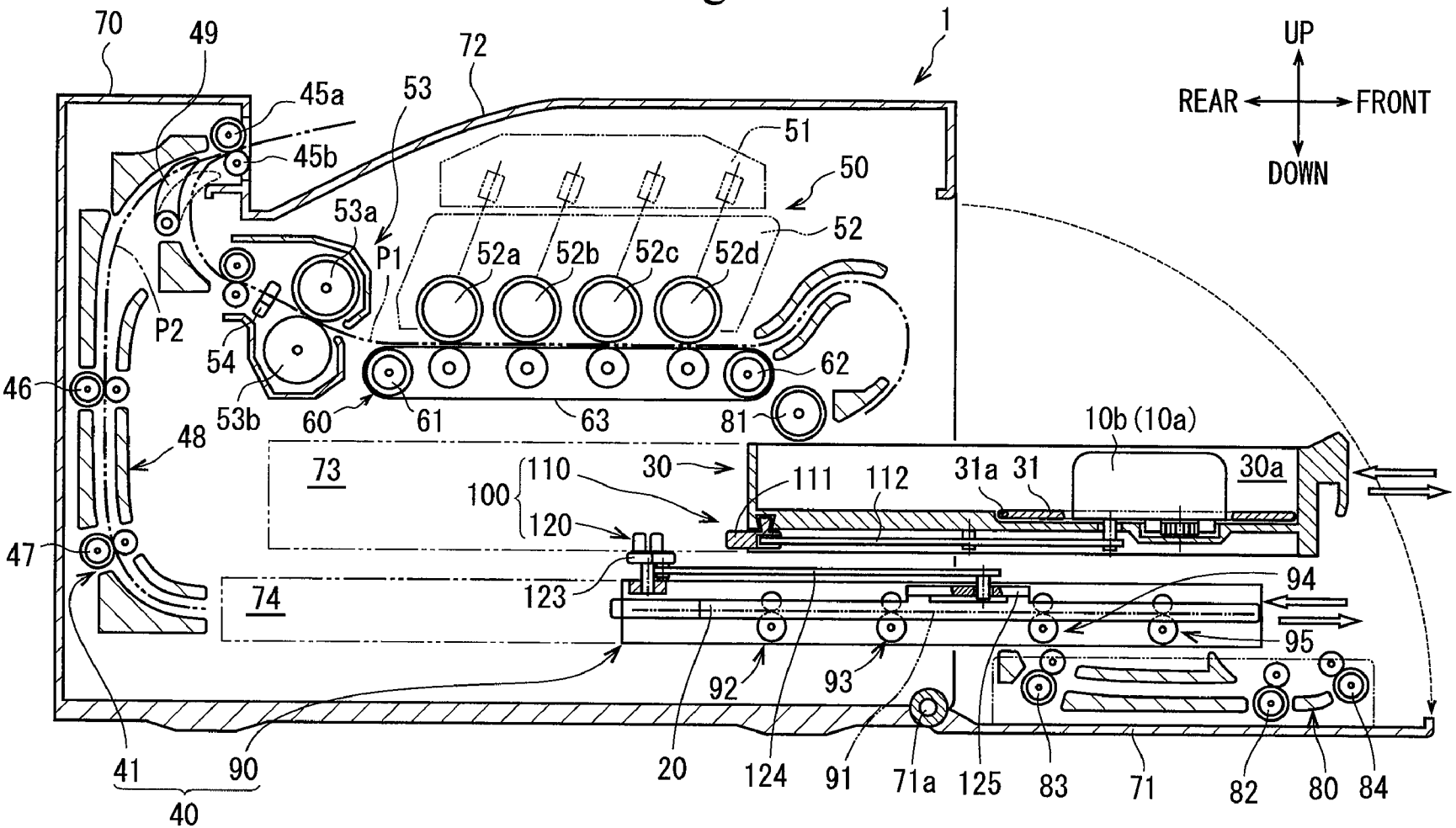
FIG. 2 is a schematic sectional view showing a condition in which an openable panel is opened according to the printer of embodiment 1.

As shown in FIGS. 1 and 2, a printer 1 as an image forming apparatus of embodiment 1 includes a housing 70, a sheet feed cassette 30, a feeder unit 80, a transport mechanism 60, an image forming unit 50, a reverse transport mechanism 40, a first width regulation mechanism, a second width regulation mechanism, and a link mechanism 100. The first width regulation mechanism has a pair of guide plates 10*a*, 10*b* as main component elements. Hereinafter, the first width regulation mechanism is referred to as "the first width regulation mechanisms 10a, 10b". The second width regulation mechanism has one elongated rectangular guide plate 20 as a main component element. Hereinafter, the second width regulation mechanism is referred to as "the second width regulation mechanism 20". The reverse transport mechanism 40 has a reverse guide part 41 and a retransport tray 90. The link mechanism 100 is configured by an output part 110 and an input part 120. As below, the respective component elements forming the printer 1 will be described in detail.

1. Housing

The housing 70 has a substantially box shape (substantially rectangular parallelepiped shape) made of metal, resin, or the like. A frame member (not shown) made of metal, resin, or the like is provided inside the housing 70, and the sheet feed cassette 30, the feeder unit 80, the image forming unit 50, the transport mechanism 60, the reverse transport mechanism 40, etc. are mounted to the frame member.

As shown in FIG. 2, an openable panel 71 that swings forward around a hinge 71*a* at the lower end as a pivot for opening the front side of the housing 70 is provided. On the inner wall of the openable panel 71, the feeder unit 80 (except part of the members such as a sheet feed roller 81) is fixed via the frame member (not shown). When the openable panel 71 is opened, also the feeder unit 80 swings forward with the hinge 71*a* as a pivot for opening the front side of the housing 70.

A paper eject tray 72 on which the sheets (e.g., paper or OHP sheets) ejected to the outside of the housing 70 after image formation is provided on the top of the housing 70.

As shown in FIG. 2, a sheet feed cassette housing chamber 73 is provided in the lower part of the housing 70, and further, a retransport tray housing chamber 74 is provided underneath.

Further, with the openable panel 71 opened, the sheet feed cassette 30 can be housed in the sheet feed cassette housing chamber 73 by pushing the sheet feed cassette 30 from the front side toward the rear side, and the sheet feed cassette 30 can be detached from the sheet feed cassette housing chamber 73 by drawing the sheet feed cassette 30 from the rear side toward the front side.

Furthermore, with the openable panel 71 opened, the retransport tray 90 can be housed in the retransport tray housing chamber 74 by pushing the retransport tray 90 from the front side toward the rear side, and the retransport tray 90 can be detached from the retransport tray housing chamber 74 by drawing the retransport tray 90 from the rear side toward the front side.

2. Sheet Feed Cassette

The sheet feed cassette 30 has a substantially box shape (substantially rectangular parallelepiped shape) made of metal, resin, or the like, and a sheet holding chamber 30*a* with an open top is recessed therein. The sheet holding chamber 30*a* can hold stacked sheets.

Figure 3:
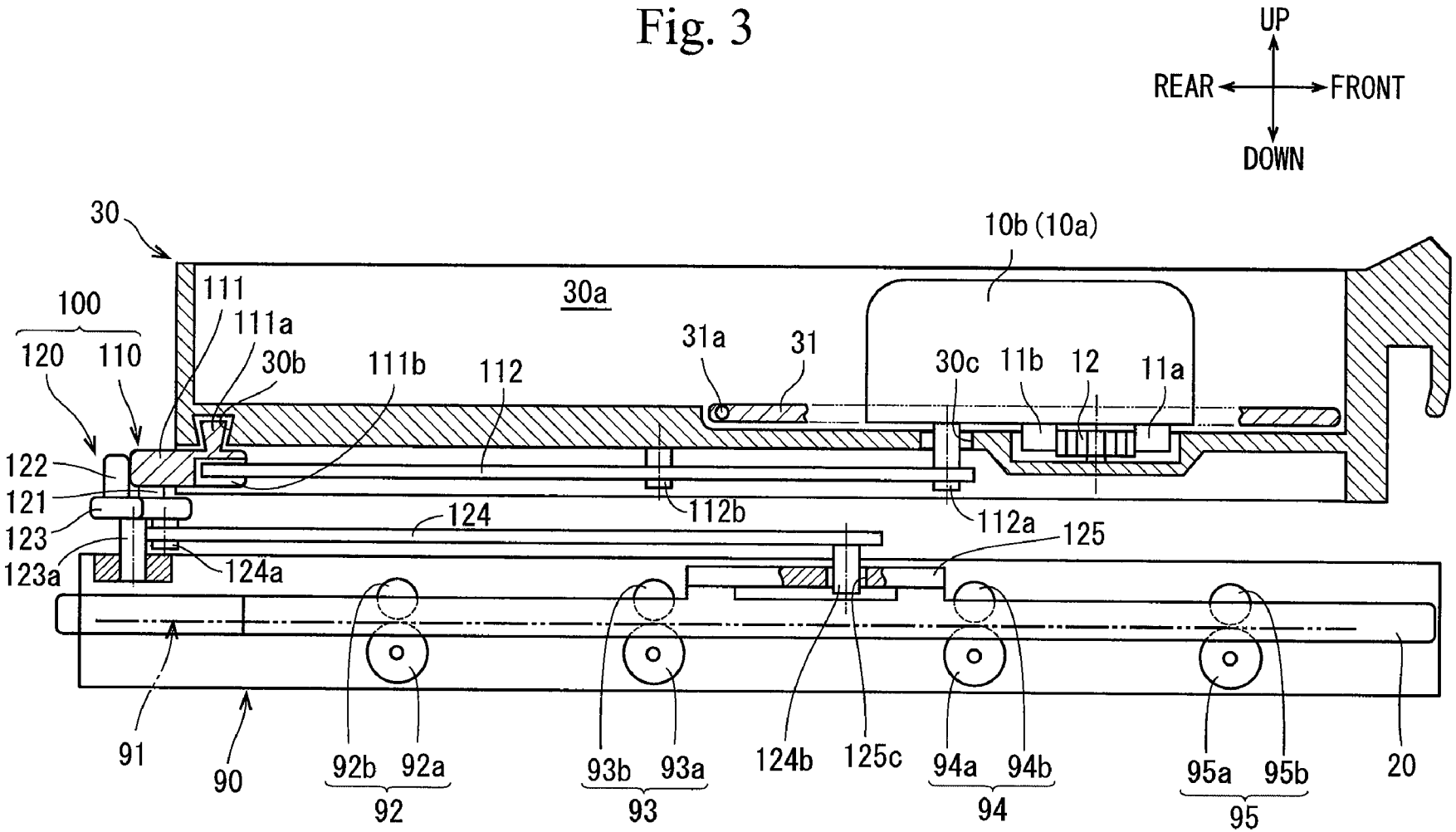
FIG. 3 is a schematic sectional view showing a sheet feed cassette, a retransport tray, and a link mechanism according to the printer of embodiment 1.
Figure 4:
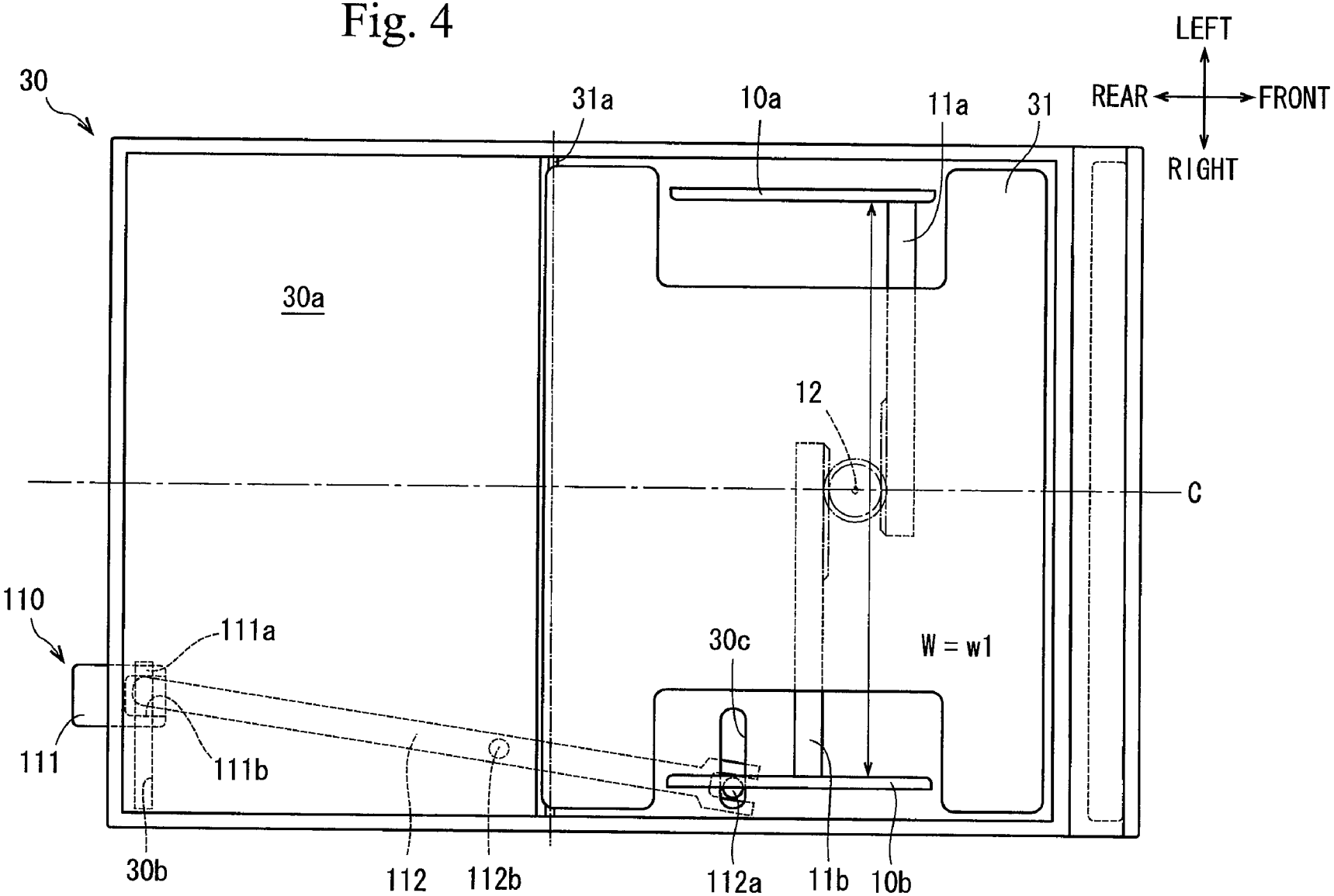
FIG. 4 is a schematic top view showing the sheet feed cassette and an output part of the link mechanism according to the printer of embodiment 1.
Figure 5:
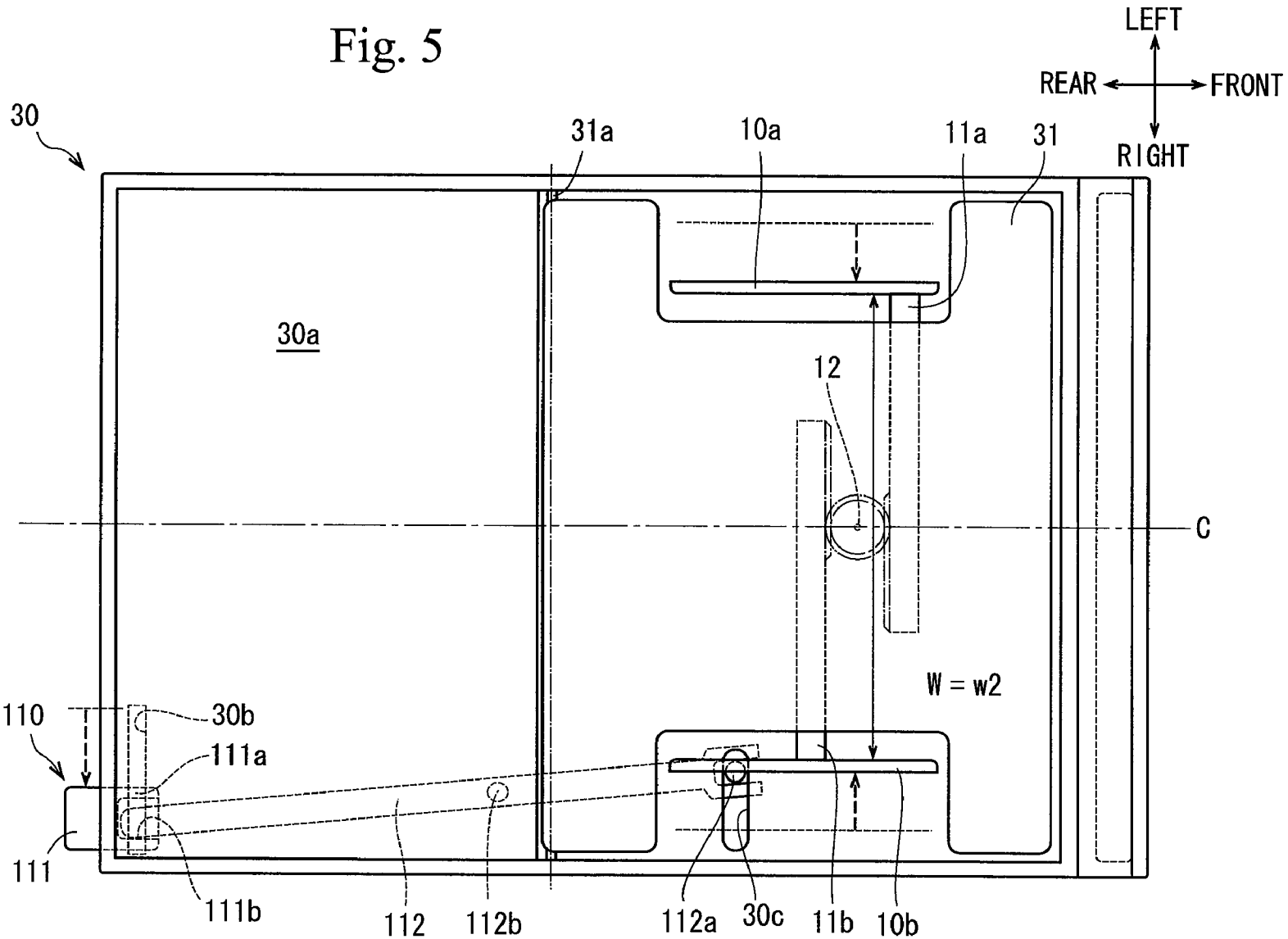
FIG. 5 is a schematic top view showing the sheet feed cassette and the output part of the link mechanism according to the printer of embodiment 1.

As specifically shown in FIGS. 3 to 5, a pressure plate 31 is provided at the front bottom part of the sheet holding chamber 30*a*. The rear end of the pressure plate 31 is journaled by a pivot 31*a* provided along the lateral direction (from the depth side toward the front side in FIG. 3), and the front end of the pressure plate 31 is vertically pivotable. The pressure plate 31 is substantially "H"-shaped seen from above, and arranged to prevent interference when the first width regulation mechanisms 10*a*, 10*b* move in the lateral direction according to the width W of the sheet. When a sheet is fed to the image forming unit 50, the pressure plate 31 pivots to push the front end of the sheet contained in the sheet holding chamber 30*a* upwardly and press the front end against the sheet feed roller 81 located above.

3. First Width Regulation Mechanism

The first width regulation mechanisms 10*a*, 10*b* are provided within the sheet holding chamber 30*a* and have the pair of guide plates 10*a*, 10*b* as main component elements, which are opposed in the lateral direction with the center line C shown in FIGS. 4 and 5 as the reference position. The center line C is the same as the center C of the image formation range of the image forming unit 50. Further, the first width regulation mechanisms 10*a*, 10*b* have rack parts 11*a*, 11*b* and a gear 12 provided below the pressure plate 31 within the sheet holding chamber 30*a*. By interlocking these rack parts 11*a*, 11*b* with the gear 12, the first width regulation mechanisms 10*a*, 10*b* are constantly positioned at the equal distance from the center line C.

The first width regulation mechanisms 10*a*, 10*b* having such a configuration are positioned according to the sheet width W with the center C (center line C) of the image formation range of the image forming unit 50 as the reference position, and regulate the sheet not to be off the center line C in the lateral direction.

For example, as shown in FIG. 4, when the sheet width W is w1 in a large size (e.g., letter-size), the first width regulation mechanisms 10*a*, 10*b* separate at the equal distance (w1/2) from the center line C as the reference position in the lateral direction and regulate the sheet. On the other hand, as shown in FIG. 5, when the sheet width W is w2 in a small size (e.g., A4-size), the first width regulation mechanism 10*a*, 10*b* respectively come closer at the equal distance (w2/2) from the center line C as the reference position in the lateral direction and regulate the sheet. Hereinafter, the sheet transport not to position the sheet at ends in the width direction but to position the sheet with the center in the width direction as reference is called center-registration transport.

4. Link Mechanism (Output Part)

The output part 110 forming the link mechanism 100 is provided at the lower surface of the sheet feed cassette 30 as shown in FIGS. 3 to 5. The output part 110 has an output part main body 111 and a transmitting member 112. When the sheet feed cassette 30 is drawing from the sheet feed cassette housing chamber 73, the output part 110 is also drawn integrally with the sheet feed cassette 30.

The output part main body 111 is a small block in a substantially rectangular parallel piped shape and provided at the rear end of the lower surface of the sheet feed cassette 30. A guide projection 111*a* is projected upwardly at the front of the upper surface of the output part main body 111, and an engaging recess 111*b* that engages with the rear end of the transmitting member 112 is recessed at the front of the lower surface. The guide projection 111*a* is fit in a rail groove 30*b* recessed in the lateral direction at the rear end of the lower surface of the sheet feed cassette 30. Accordingly, the output part main body 111 is movable in the lateral direction along the rail groove 30*b* as shown in FIGS. 4 and 5.

The transmitting member 112 has a rod shape extending in the anteroposterior direction, and the front end in a branched shape engages with an engaging pin 112*a* that passes from the lower end of the first width regulation mechanism 10*b* through a slot 30*c* of the bottom wall of the sheet feed cassette 30 and protrude to the lower surface side, the central part is pivotably journaled within a horizontal plane with a pivot 112*b* downwardly projected from the bottom wall of the sheet feed cassette 30, and the rear end is inserted into an engaging recess 111*b* of the output part main body 111.

In the output part 110 having a such configuration, when the sheet width W is w1 and the first width regulation mechanisms 10*a*, 10*b* are positioned separately from each other according to the sheet width W=w1 as shown in FIG. 4, accordingly, the front end of the transmitting member 112 swings to the right, and oppositely, the rear end of the transmitting member 112 swings to the left. Consequently, the swing of the rear end of the transmitting member 112 is transmitted via the engaging recess 111*b* to the output part main body 111 and the output part main body 111 moves to the left. On the other hand, when the sheet width W is w2 and the first width regulation mechanisms 10*a*, 10*b* are positioned closely to each other according to the sheet width W=w2 as shown in FIG. 5, accordingly, the transmitting member 112 swings toward the opposite direction and the output part main body 111 moves to the right. In this manner, the output part 110 changes the positions of the first width regulation mechanisms 10*a*, 10*b* in two ways according to the sheets in two sizes, and accordingly, changes the position of the output part main body 111 in two ways in association with the change.

5. Feeder Unit

The feeder unit 80 includes the sheet feed roller 81, transport rollers 82, 83, a registration roller 84, etc. as shown in FIG. 1.

The sheet feed roller 81 is provided above the front end of the sheet feed cassette 30 for feeding (transporting) the sheets placed in the sheet feed cassette 30 to the image forming unit 50. A separation pad (not shown) is provided below the front of the sheet feed roller 81 for separating sheets sheet-fed by the sheet feed roller 81 one by one by providing predetermined transport resistance to the sheets.

In a transport path P1 of sheets turning around at the front within the housing 70, through which sheets are transported to the image forming unit 50 provided near the center within the housing 70, the transport roller 82 is provided in a part turning around in a substantially U-shape at the front to provide transport force to the sheets to be transported while curving the sheets in the substantially U-shape to the image forming unit 50.

The registration roller 84 is provided at the downstream of the transport roller 82 in the transport path P1 for correcting the skew of the sheet by contacting the front end of the sheet transported by the transport roller 82, and then, further transporting the sheet toward the image forming unit 50.

The transport roller 83 is provided lower than the transport roller 82 at the front of the retransport tray 90 for providing transport force to the sheet turned over by the reverse transport mechanism 40 to guide the sheet to the transport path P1 again.

5. Transport Mechanism

The transport mechanism 60 includes a driving roller 61 rotating in association with the actuation of the image forming unit 50, a driven roller 62 rotatably provided in a position apart from the driving roller 61, a transport belt 63 wrapped around the driving roller 61 and the driven roller 62, etc.

The transport belt 63 turns with the sheets thereon, and thereby, the sheet transported from the sheet feed cassette 30 moves along the transport path P1 and is transported to a developing toner cartridge 52 within the image forming unit 50.

6. Image Forming Unit

The electrophotographic system is adopted for the image forming unit 50 in the printer 1 of embodiment 1. In the image forming apparatus of the invention, the image forming unit is not limited to that in embodiment 1, and may adopt a general image formation system of electrophotographic, thermal, inkjet, and other systems.

The image forming unit 50 is of so-called direct tandem system capable of color printing, and include a scanner 51, the developing toner cartridge 52, a fixing unit 53, etc.

The developing toner cartridge 52, though the details are not shown, is an assembly of four cartridges corresponding to toners (developers) of four colors of black, yellow, magenta, cyan and arranged along the sheet transport direction in a line, and includes photoconductor drums 52*a*, 52*b*, 52*c*, 52*d*, developing rollers, chargers, toner containers, etc. (not shown). The developing toner cartridge 52 is detachably mounted to the above described frame member.

The scanner 51 is provided at the upper part within the housing 70 for forming electrostatic latent images on the surfaces of the respective photoconductor drums 52*a*, 52*b*, 52*c*, 52*d* within the developing toner cartridge 52, and specifically includes a laser source, a polygon mirror, an fθ lens, reflecting mirrors, etc.

The fixing unit 53 is provided at the downstream of the photoconductor drums 52*a*, 52*b*, 52*c*, 52*d* in the sheet transfer path P1, and includes a heating roller 53*a* provided at the image formation surface side of the sheet for providing transport force to the sheet while heating the toner thereon, a pressure roller 53*b* provided at the opposite side to the heating roller 53*a* with the sheet in between for pressing the sheet against the heating roller 53*a*, etc. The fixing unit 53 is also detachably mounted to the above described frame member.

The heating roller 53*a* is rotationally driven in synchronization with the transport belt 63 and so on, while the pressure roller 53*b* is driven to rotate by the rotational force from the heating roller 53*a* via the sheet in contact with the heating roller 53*a*. Further, a paper eject sensor 54 facing the transport path P1 is provided between the heating roller 53*a* and the pressure roller 53*b*, and the rear end of the sheet is sensed by the paper eject sensor 54 when the sheet is reversely transported as will be described later, and paper eject rollers 45*a*, 45*b* are negatively rotated from the positive rotation with predetermined timing after the sensing.

In the image forming unit 50 having such a configuration, images are formed on a sheet in the following manner. The surfaces of the photoconductor drums 52*a*, 52*b*, 52*c*, 52*d* are evenly and positively charged by the chargers while rotating, and then, exposed to light by the high-speed scanning of the laser beam radiated from the scanner 51. Thereby, electrostatic latent images corresponding to the images to be formed on the sheet are formed on the surfaces of the photoconductor drums 52*a*, 52*b*, 52*c*, 52*d*.

Then, the toners are supplied from the toner container to the surfaces of the photoconductor drums 52*a*, 52*b*, 52*c*, 52*d* according to the electrostatic latent images, and the toners carried on the surfaces of the photoconductor drums 52*a*, 52*b*, 52*c*, 52*d* are transferred to the sheet. Then, the sheet with transferred toners is transported to the fixing unit 53 and heated there, and thereby, the toners are fixed in the sheet and the image formation is completed.

7. Reverse Transport Mechanism

The reverse transport mechanism 40 is for forming images on both front and rear sides of the sheet, and has the reverse guide part 41 and the retransport tray 90. The reverse guide part 41 and the retransport tray 90 are provided along a reverse transport path P2, through which the sheet passing through the fixing unit 53 is transported to return from the rear side of the housing 70 through the lower part of the sheet feed cassette 30 to the feeder unit 80.

The reverse guide part 41 includes paper eject rollers 45*a*, 45*b*, a flapper 49, retransport rollers 46, 47, a guide 48, etc.

The paper eject rollers 45*a*, 45*b* include a pair of opposed rollers and are configured to be switched between positive and negative rotations. As described above, the paper eject rollers 45*a*, 45*b* positively rotate and transport the sheet in the paper eject direction when the sheet is ejected onto the paper eject tray 72, and negatively rotate when the sheet is reversed and transported into the reverse transport path P2.

The flapper 49 is pivotably provided facing the branched part of the transport path P1 and the reverse transport path P2 for switching the transport direction of the sheet reversed by the paper eject rollers 45*a*, 45*b* through excitation or non-excitation of a solenoid (not shown) from the direction toward the transport path P1 to the direction toward the reverse transport path P2.

The retransport rollers 46, 47, and the guide 48 are provided in the vertical direction along the reverse transport path P2 so as to transport the sheet from the paper eject rollers 45*a*, 45*b* to the rear end of the retransport tray 90 provided at the lowermost part of the housing 70.

In the reverse guide part 41, the reversed sheet is not positioned at the end in the width direction, but positioned with reference to the center in the sheet width direction like the transport path P1 for sheet transport (center-registration transport).

Figure 6:
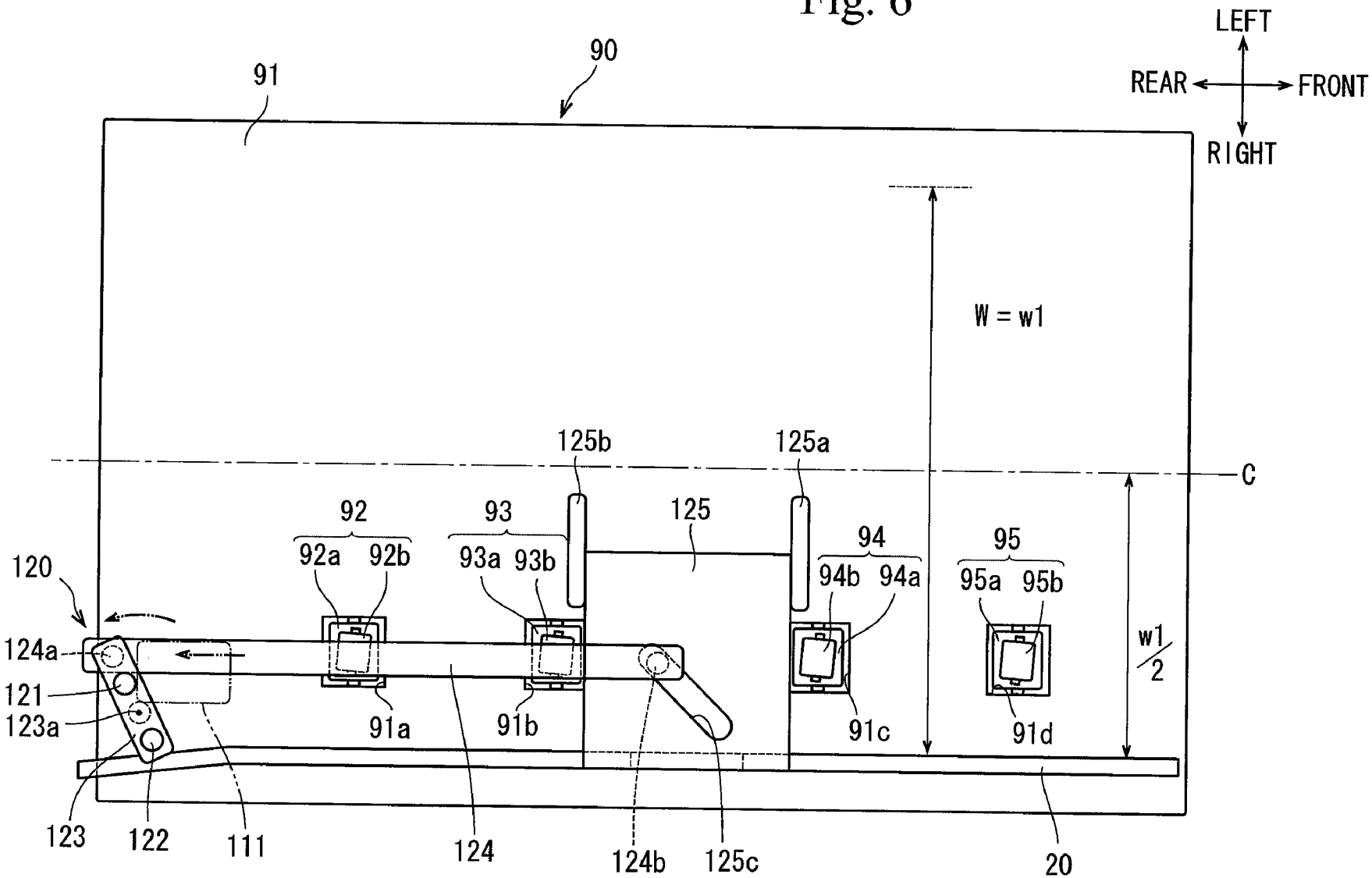
FIG. 6 is a schematic top view showing the retransport tray and an input part of the link mechanism according to the printer of embodiment 1.
Figure 7:
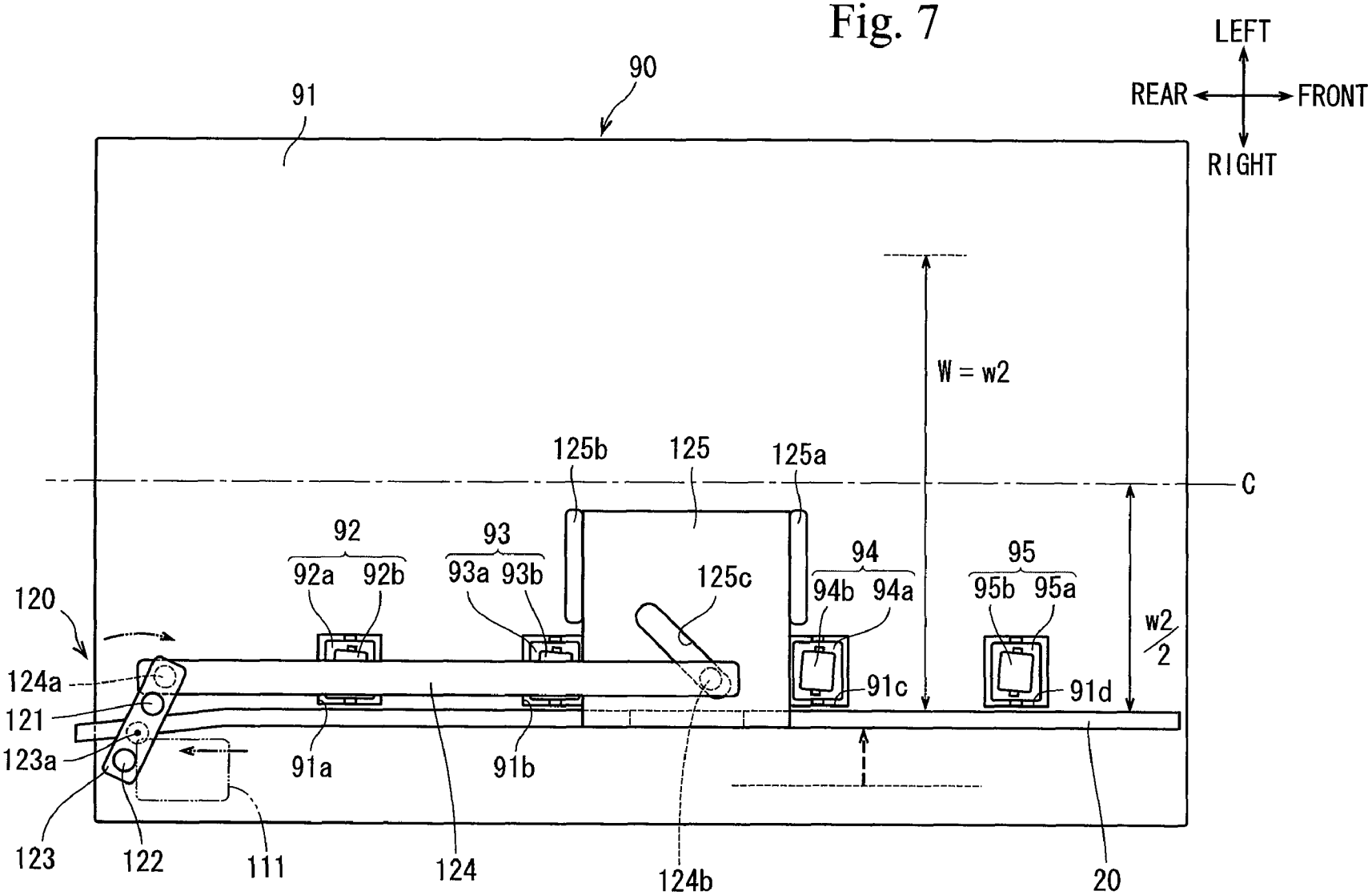
FIG. 7 is a schematic top view showing the retransport tray and the input part of the link mechanism according to the printer of embodiment 1.

The retransport tray 90 is provided below the sheet feed cassette 30, and its rear end is located at the front of the lower end of the reverse guide part 41 and the front end is located at the rear of the transport roller 83. The retransport tray 90 has the tray main body 91 and skewing roller units 92, 93, 94, 95 as shown in FIGS. 3, 6, and 7.

The tray main body 91 has a nearly plate-like shape on which the sheet can be transported along the upper surface thereof. As shown in FIGS. 6 and 7, four openings 91*a*, 91*b*, 91*c*, 91*d* arranged in the anteroposterior direction are provided at the right side of the center line C of the tray main body 91. The respective openings 91*a*, 91*b*, 91*c*, 91*d* are for exposing driving rollers 92*a*, 93*a*, 94*a*, 95*a* of the skewing roller units 92, 93, 94, 95.

Further, the second width regulation mechanism 20 extending in the anteroposterior direction is provided at the right side of the openings 91*a*, 91*b*, 91*c*, 91*d* at the upper surface of the tray main body 91, and the input part 120 of the link mechanism 100 is provided above the tray main body 91.

The skewing roller units 92, 93, 94, 95 include the driving rollers 92*a*, 93*a*, 94*a*, 95*a* and the skewing rollers 92*b*, 93*b*, 94*b*, 95*b*.

The driving rollers 92*a*, 93*a*, 94*a*, 95*a* have rotational axes perpendicular to the sheet transport direction, and are provided at the lower surface side of the tray main body 91 with the upper parts exposed from the openings 91*a*, 91*b*, 91*c*, 91*d*. The driving rollers 92*a*, 93*a*, 94*a*, 95*a* are rotationally driven in synchronization by driving means (not shown). Further, the driving rollers 92*a*, 93*a*, 94*a*, 95*a* and the driving means are arranged so that the transmission of driving force may be shut when the retransport tray 90 is drawn out from the retransport tray housing chamber 74.

The skewing rollers 92*b*, 93*b*, 94*b*, 95*b* are provided above with rotational axes inclined relative to the driving rollers 92*a*, 93*a*, 94*a*, 95*a* and arranged to be driven to rotate according to the driving rollers 92*a*, 93*a*, 94*a*, 95*a*. Further, the skewing rollers 92*b*, 93*b*, 94*b*, 95*b* sandwich the sheet passing thorough the tray main body 91 with the driving rollers 92*a*, 93*a*, 94*a*, 95*a* and transports the sheet while skewing the sheet toward the second width regulation mechanism 20 (right).

The skewing roller units 92, 93, 94, 95 having such a configuration transport the sheet while positioning the sheet by pressing one end of the sheet in the width direction against the second width regulation mechanism 20. The transport while positioning the sheet with one end of the sheet in the width direction as reference is called side-registration transport as below. Further, the mechanism of transport (side-registration transport) while regulating the one end of the sheet in the width direction is called a side-registration transport mechanism. The skewing roller units 92, 93, 94, 95 and the second width regulation mechanism 20 form the side-registration transport mechanism, and transport the sheet transported from the reverse guide part 41 through the center-registration transport along the reverse transport path P2 without displacement relative to the image formation range of the image forming unit 50.

8. Second Width Regulation Mechanism

As shown in FIGS. 3, 6, and 7, the second width regulation mechanism 20 is made of metal, resin, or the like, and has one elongated rectangular guide plate 20 extending in the anteroposterior direction (the direction in parallel to the sheet transport direction) as a main component element. The rear end of the second width regulation mechanism 20 curves apart from the center line C, and corrects the displacement along the curve even when the sheet transported from the reverse guide part 41 to the retransport tray 90 is displaced from the center line C in the width direction.

The second width regulation mechanism 20 is positioned according to the sheet width W by the input part 120 forming the link mechanism 100, which will be described later, and contacts the right edge of the sheet being transported on a skew toward the second width regulation mechanism 20 and regulates the sheet position in the width direction.

9. Link Mechanism (Input Part)

The input part 120 forming the link mechanism 100 is provided above the tray main body 91 by being supported by a frame member at the retransport tray side (not shown) extending upwardly from the tray main body 91 as shown in FIGS. 3, 6, and 7. The input part 120 has a swing member 123, a sliding portion 125, and a transmitting member 124. When the retransport tray 90 is drawn from the retransport tray housing chamber 74, the input part 120 is also drawn integrally with the retransport tray 90.

As shown in FIGS. 6 and 7, the swing member 123 has a short rod-like shape extending in the lateral direction, and swingably journaled within the horizontal plane by a swing shaft 123*a* upwardly projected from the rear end of the tray main body 91. A first pin 121 is upwardly projected on the upper surface at the left end of the swing member 123 and a second pin 122 is upwardly projected on the upper surface at the right end. The positions of the first pin 121 and the second pin 122 are located in positions where the pins can contact the output part main body 111 located at the left or right when the sheet feed cassette 30 is completely housed in the sheet feed cassette housing chamber 73. Further, an engaging pin 124*a* is downwardly projected on the lower surface at the left end of the swing member 123.

The sliding portion 125 is movable in the lateral direction within the horizontal plane by being guided by guide portions 125*a*, 125*b* fixed to the frame member at the retransport tray side (not shown) above the tray main body 91. The right edge of the sliding portion 125 is connected to the upper central part of the second width regulation mechanism 20. Further, a guide slot 125*c* inclined at about 45° relative to the anteroposterior direction is penetrated at the center of the sliding portion 125.

The transmitting member 124 has a rod-like shape extending in the anteroposterior direction, and the rear end thereof is engaged with the engaging pin 124*a* of the swing member 123. A guide pin 124*b* is downwardly projected on the lower surface of the front end of the transmitting member 124. The guide pin 124*b* is inserted through the guide slot 125*c*, and its outer diameter is suitably set so that the pin may smoothly move without rattling within the guide slot 125*c*. Accordingly, when the transmitting member 124 moves in the anteroposterior direction, the anteroposterior motion is converted into lateral motion by the guide pin 124*b*, the guide slot 125*c*, and the guide portions 125*a*, 125*b*, and the sliding portion 125 moves in the lateral direction. As a result, the second width regulation mechanism 20 also moves in the lateral direction according to the motion of the sliding portion 125.

The input part 120 having such a configuration acts in the following manner when the retransport tray 90 is housed in the retransport tray housing chamber 74.

First, when the positions of the first width regulation mechanisms 10*a*, 10*b* are changed according to the width W=w1 of sheets stacked in the sheet holding chamber 30*a* as shown in FIG. 4 under a condition that the sheet feed cassette 30 is completely drawn out or halfway drawn out from the sheet feed cassette housing chamber 73, the output part main body 111 moves to the left by the above described action of the output part 110.

Secondly, when the sheet feed cassette 30 under the condition of FIG. 4 is pushed into the sheet feed cassette housing chamber 73 and completely housed, as shown in FIG. 6, the first pin 121 contacts the output part main body 111 at the left, and further, the first pin 121 is pushed by the output part main body 111 and moves rearward. With the movement, the swing member 123 swings and the transmitting member 124 moves rearward via the engaging pin 124*a*. Then, the guide pin 124*b* also moves rearward and the sliding portion 125 moves to the right via the guide slot 125*c*. As a result, the second width regulation mechanism 20 moves to the right according to the movement of the sliding portion 125. Thereby, the distance between the second width regulation mechanism 20 and the center line C is w1/2. Accordingly, the second width regulation mechanism 20 can retransport the sheet at the width W=w1 without displacement relative to the center line C through the side-registration transport.

On the other hand, when the positions of the first width regulation mechanisms 10*a*, 10*b* are changed according to the width W=w2 of the sheets stacked in the sheet holding chamber 30*a* as shown in FIG. 5 under a condition that the sheet feed cassette 30 is completely drawn out or halfway drawn out from the sheet feed cassette housing chamber 73, the output part main body 111 moves to the right by the above described action of the output part 110.

Next, when the sheet feed cassette 30 under the condition of FIG. 5 is pushed into the sheet feed cassette housing chamber 73 and completely housed, as shown in FIG. 7, the second pin 122 contacts the output part main body 111 at the right, and further, the second pin 122 is pushed by the output part main body 111 and moves rearward. With the movement, the swing member 123 oppositely swings and the transmitting member 124 moves forward via the engaging pin 124*a*. Then, the guide pin 124*b* also moves forward and the sliding portion 125 moves to the left via the guide slot 125*c*. As a result, the second width regulation mechanism 20 also moves to the left according to the movement of the sliding portion 125. Thereby, the distance between the second width regulation mechanism 20 and the center line C is w2/2. Accordingly, the second width regulation mechanism 20 can retransport the sheet at the width W=w2 without displacement relative to the center line C through the side-registration transport.

In the printer 1 of embodiment 1 having the above described configuration, image formation on both front and rear sides of the sheet is performed by the reverse mechanism 40, the second width regulation mechanism 20, and the link mechanism 100 in the following manner.

When a sheet with an image formed on the front side is transported from the transport path P1 to the paper eject rollers 45*a*, 45*b* by the transport belt 63 and so on, the paper eject rollers 45*a*, 45*b* positively rotate with the sheet in between and once transports the sheet toward the outside (paper eject tray 72 side), and stop the positive rotation when most of the sheet is transported to the outside and the rear end of the sheet is sandwiched between the paper eject rollers 45*a*, 45*b*.

Then, when the paper eject rollers 45*a*, 45*b* negatively rotate, the flapper 49 switches the transport direction so that the sheet may be transported along the reverse transport path P2, and the rollers transport the sheet in the reverse orientation to the reverse guide part 41. The timing with which the paper eject rollers 45*a*, 45*b* are negatively rotated from the positive rotation is controlled to be the time after a predetermined time has elapsed from when the rear end of the sheet is sensed by the paper eject sensor 54 as described above. Further, when the sheet transportation is finished, the flapper 49 is switched to the original state, that is, to transport the sheet from the transport belt 63 and so on to the paper eject rollers 45*a*, 45*b*.

Next, the sheet transported in the reverse orientation to the reverse guide part 41 is transported to the retransport tray 90, and regulated by the skewing roller units 92 to 95 and the second width regulation mechanism 20 without displacement in the width direction relative to the center line C. Then, the sheet is transported again from the retransport tray 90 in the reversed state to the image forming unit 50 via the transport rollers 83, 82, and the registration roller 84. In this manner, the printer 1 can form predetermined images on both front and rear sides of the sheet.

Here, in the printer 1 of embodiment 1, the link mechanism 100 mechanically changes the position of the second width regulation mechanism 20 in association with the position change of the first width regulation mechanisms 10*a*, 10*b* as described above. Accordingly, unlike the conventional image forming apparatus, the error that a user changes the positions of the first width regulation mechanisms 10*a*, 10*b* according to the width W of sheets placed in the sheet feed cassette 30, but forgets about changing the position of the second width regulation mechanism 20 hardly occurs. Therefore, in the printer 1 of embodiment 1, the positions of the first width regulation mechanisms 10*a*, 10*b* and the position of the second width regulation mechanism 20 are constantly matched.

Therefore, the printer 1 of embodiment 1 can prevent sheet jams and displacement of image formation when images are formed on both front and rear sides.

Further, the printer 1 mechanically interlocks the positions of the first width regulation mechanisms 10*a*, 10*b* and the position of the second width regulation mechanism 20, and thus, the motion is more reliable and less expensive compared to the case where they are electrically interlocked. Furthermore, it is not necessary for the printer 1 to supply power to change the position of the second width regulation mechanism 20, and thus, even when the printer 1 is powered ON, the positional adjustment between the first width regulation mechanisms 10*a*, 10*b* and the second width regulation mechanism 20 as an initial operation is not required.

Further, in the printer 1, the link mechanism 100 is configured by the above described output part 110 and input part 120. Accordingly, in the printer 1, the link mechanism 100 can change the position of the second width regulation mechanism 20 in association with the position change of the first width regulation mechanisms 10*a*, 10*b* through the simple operation by changing the positions of the first width regulation mechanisms 10*a*, 10*b* according to the sheet width W under the condition that the sheet feed cassette 30 is completely drawn out or halfway drawn out, and then, pushing the sheet feed cassette 30 when the sheet feed cassette 30 is housed within the housing 70. Therefore, the printer 1 can reliably exert the effects of the invention.

Furthermore, in the printer 1, the reverse transport mechanism 40 has the above described reverse guide part 41 and the retransport tray 90, and the retransport tray 90 and the second width regulation mechanism 20 are provided at the lower surface side of the sheet feed cassette 30. Therefore, the printer 1 can reliably exert the effects of the invention while downsizing the apparatus.

Further, in the printer 1, the retransport tray 90 is configured to be detachable from the housing 70. Therefore, in the printer 1, the reverse transport path P2 of sheets within the reverse transport mechanism 40 can be opened by detaching the retransport tray 90, and jammed sheet within the reverse transport mechanism 40 can be easily removed.

Embodiment 2

In a printer of embodiment 2, the second width regulation mechanism 20 and the link mechanism 100 in the printer 1 of embodiment 1 are changed to a second width regulation mechanism and a link mechanism 200 shown in FIGS. 8 to 11. The second width regulation mechanism has a pair of elongated rectangular guide plates 220*a*, 220*b* as main component elements. Hereinafter, the second width regulation mechanism is referred to as "the second width regulation mechanisms 220*a*, 220*b*". The rest of the configuration is the same as that of the printer 1 of embodiment 1. Accordingly, in the embodiment 2, the description will be centered on the second width regulation mechanisms 220*a*, 220*b* and the link mechanism 200, and the same signs as embodiment 1 are assigned to the other component elements and the description thereof will be simplified or omitted.

In the printer of embodiment 2, the second width regulation mechanisms 220*a*, 220*b* and the link mechanism 200 are integrally provided and fixed at the lower surface of the sheet feed cassette 30.

Figure 9:
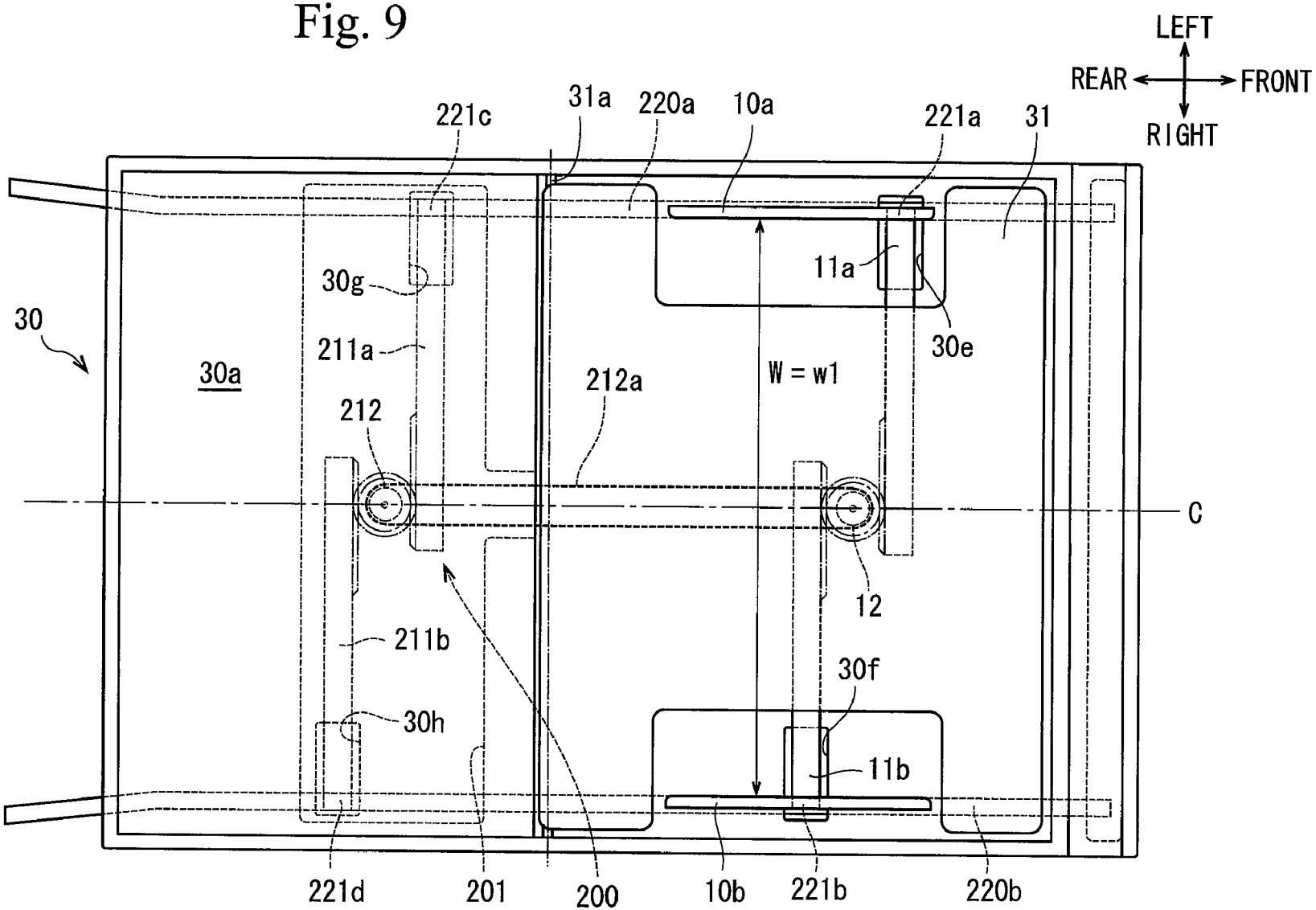
FIG. 9 is a schematic top view showing the sheet feed cassette, the second width regulation mechanism, and the link mechanism according to the printer of embodiment 2.
Figure 10:
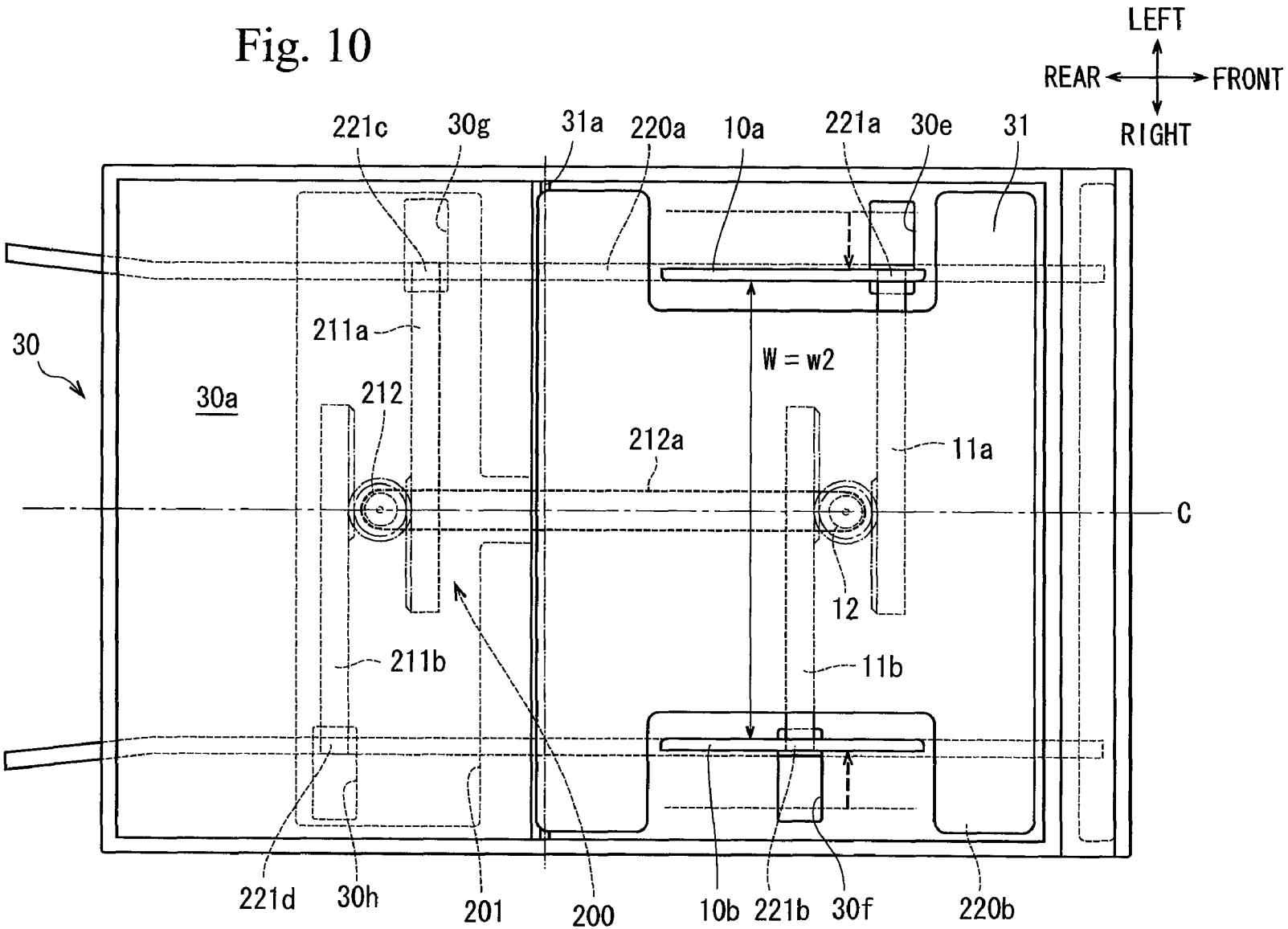
FIG. 10 is a schematic top view showing the sheet feed cassette, the second width regulation mechanism, and the link mechanism according to the printer of embodiment 2.

The second width regulation mechanisms 220*a*, 220*b* are a pair of elongated rectangular guide plates 220*a*, 220*b* as main component elements, which are opposed in the lateral direction with the center line C shown in FIGS. 9 and 10 as the reference position. The rear end of each of the second width regulation mechanisms 220*a*, 220*b* curves apart from the center line C for correcting the displacement along the curve even when the sheet transported from the reverse guide part 41 to the retransport tray 90 is slightly displaced from the center line C in the width direction. The second width regulation mechanisms 220*a*, 220*b* are for center-registration transport of the sheets to be transported to the retransport tray 90, and located in positions overlapping with the first width regulation mechanisms 10*a*, 10*b* in the lateral direction when the sheet feed cassette 30 is seen from above as shown in FIGS. 9 and 10. Further, the second width regulation mechanisms 220*a*, 220*b* are integrally fixed to connecting members 221*a*, 221*b* projecting from the lower ends of the first width regulation mechanisms 10*a*, 10*b* through slots 30*e*, 30*f* of the bottom wall of the sheet feed cassette 30 toward the lower surface side.

An inner space 201 is formed at the rear of the bottom wall of the sheet feed cassette 30, and rack portions 11*a*, 11*b* and a gear 12, and second rack portions 211*a*, 211*b* and a second gear 212 having the same shapes are provided. The gear 12 and the second gear 212 are connected with a thin timing belt 212*a*. When the gear 12 rotates, the second gear 212 rotates in the same way. Connecting members 221*c*, 221*d* projecting through slots 30*g*, 30*h* of the bottom wall of the sheet feed cassette 30 to the lower surface side are provided at the left end of the second rack portion 211*a* and the right end of the second rack portion 211*b*. The second width regulation mechanisms 220*a*, 220*b* are also integrally fixed to the connecting members 221*c*, 221*d*.

The above described connecting members 221*a*, 221*b*, 221*c*, 221*d*, timing belt 212*a*, second rack portions 211*a*, 211*b*, and second gear 212 correspond to the link mechanism 200 integrally provided and fixed at the lower surface of the sheet feed cassette 30. The link mechanism 200 mechanically changes the positions of the second width regulation mechanisms 220*a*, 220*b* in association with the position change of the first width regulation mechanisms 10*a*, 10*b*.

Figure 8:
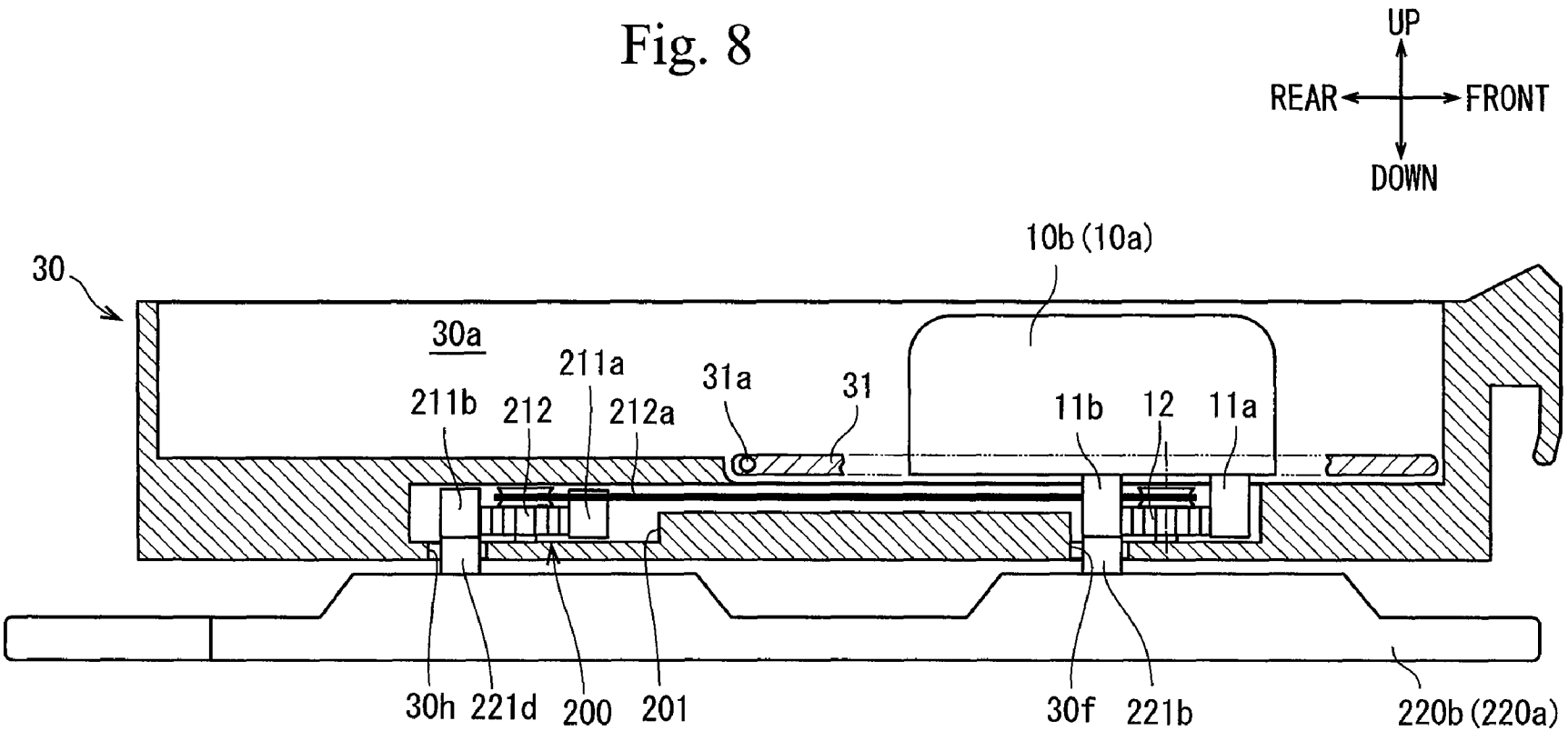
FIG. 8 is a schematic sectional view showing a sheet feed cassette, a second width regulation mechanism, and a link mechanism according to a printer of embodiment 2.

First, as shown in FIG. 8, under the condition that the sheet feed cassette 30 is completely drawn out or halfway drawn out from the sheet feed cassette housing chamber 73, as shown in FIG. 9, when the positions of the first width regulation mechanisms 10*a*, 10*b* are changed according to the width W=w1 of the sheets stacked in the sheet holding chamber 30*a*, the rack portions 11*a*, 11*b* and the gear 12 move in association and the second rack portions 211*a*, 211*b* and the second gear 212 also move in association via the timing belt 212*a* at the same time. Since the second width regulation mechanisms 220*a*, 220*b* integrally fixed to the first width regulation mechanisms 10*a*, 10*b* by the connecting members 221*a*, 221*b*, 221*c*, 221*d*, they consequently move to positions overlapping with the first width regulation mechanisms 10*a*, 10*b* in the lateral direction when the sheet feed cassette 30 is seen from above. Thereby, the second width regulation mechanisms 220*a*, 220*b* are apart from each other in the lateral direction at the equal distance (w1/2) with the center line C as the reference position like the first width regulation mechanisms 10*a*, 10*b*.

On the other hand, as shown in FIG. 10, when the positions of the first width regulation mechanisms 10*a*, 10*b* are changed according to the width W=w2 of the sheets stacked in the sheet holding chamber 30*a*, the second width regulation mechanisms 220*a*, 220*b* are close to each other in the lateral direction at the equal distance (w2/2) with the center line C as the reference position like the first width regulation mechanisms 10*a*, 10*b*.

Further, even if the width W of the sheets stacked in the sheet holding chamber 30*a* is an arbitrary value wm (w2<wm<w1), when the positions of the first width regulation mechanisms 10*a*, 10*b* are changed according to the width W=wn of the sheets, the second width regulation mechanisms 220*a*, 220*b* are apart from each other in the lateral direction at the equal distance (wm/2) with the center line C as the reference position like the first width regulation mechanisms 10*a*, 10*b*.

In this manner, the link mechanism 200 can mechanically change the positions of the second width regulation mechanisms 220*a*, 220*b* with no step in association with the position change of the first width regulation mechanisms 10*a*, 10*b*.

Figure 11:
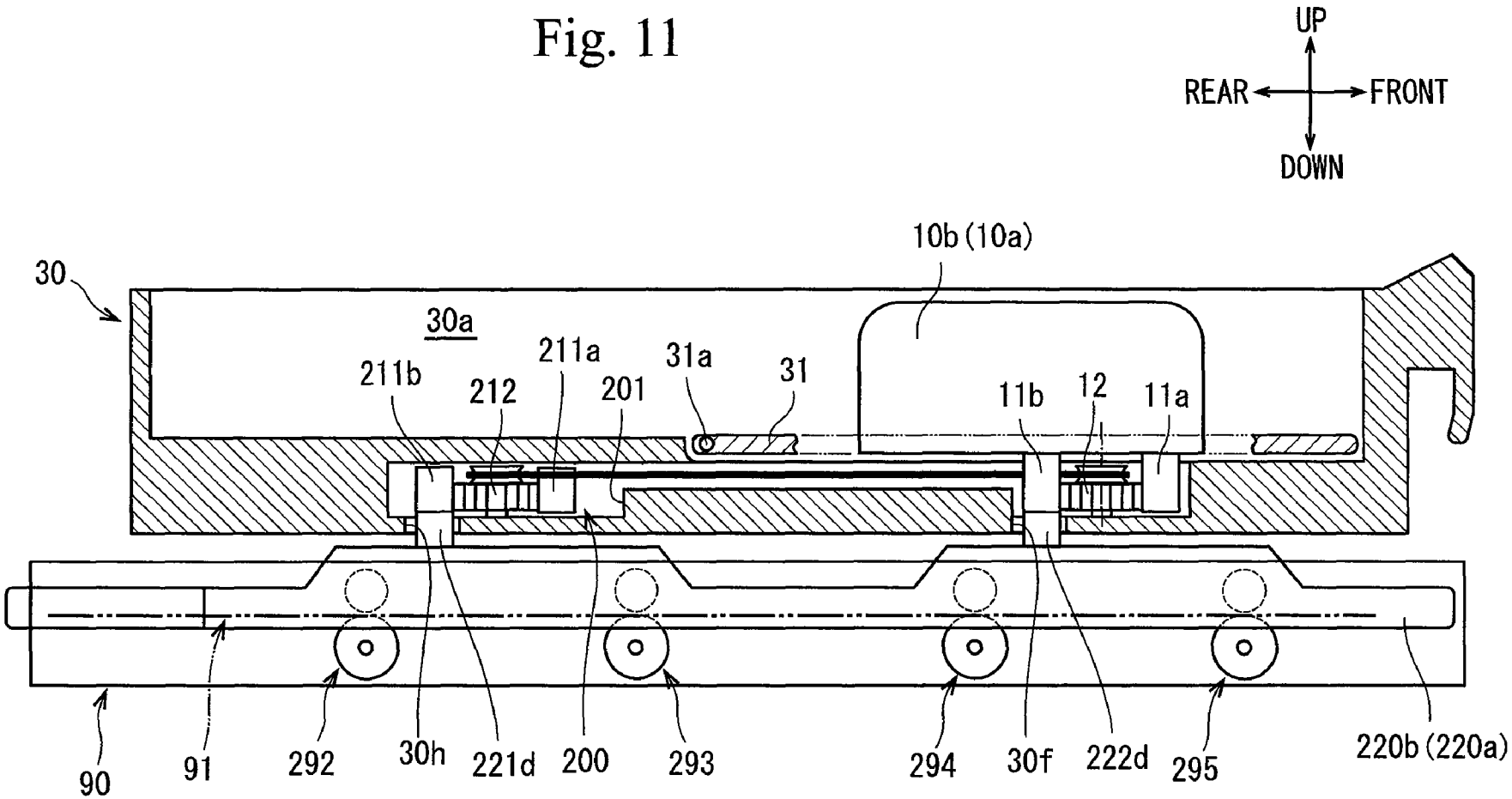
FIG. 11 is a schematic sectional view showing the sheet feed cassette, the second width regulation mechanism, and the link mechanism according to the printer of embodiment 2.

Then, when the sheet feed cassette 30 is housed in the sheet feed cassette housing chamber 73 again, as shown in FIG. 11, the second width regulation mechanisms 220*a*, 220*b* are located within the retransport tray 90. Then, the second width regulation mechanisms 220*a*, 220*b* can retransport, along the reverse transport path P2, the sheet to be transported from the reverse guide part 41 to the retransport tray 90 without displacement relative to the center line C through center-registration transport.

In the printer of embodiment 2, the retransport tray side frame members above the tray main body 91 of the retransport tray 90 and so on are eliminated so as not to interfere with the second width regulation mechanisms 220*a*, 220*b*. Further, the retransport tray 90 adopts the center registration transport in the embodiment 2, and thus, the tray has simple transport rollers 292 to 295 in place of the skewing roller units 92 to 95 as shown in FIG. 11.

The printer of embodiment 2 having such a configuration can exert the same effects as those of the printer 1 of embodiment 1.

As above, the invention has been described according to the embodiments 1, 2, however, as will be understood, the invention is not limited to the embodiments 1, 2 and appropriate changes may be made without departing from the scope of the invention.

The link mechanism may be any mechanism as long as it reliably exerts the above described effects, and general combinations of gears, levers, cams, guide rails, and other mechanical elements can be employed.

Further, in the invention, the link mechanism mechanically changes the position of the second width regulation mechanism in association with the position change of the first width regulation mechanism, and another invention that is easier and less expensive may be adopted.

A link mechanism in another invention can prevent the sheet feed cassette to be completely housed within the housing if the position of the first width regulation mechanism and the position of the second width regulation mechanism are different when the sheet feed cassette is housed within the housing. In this case, the user may notice that the position of the first width regulation mechanism and the position of the second width regulation mechanism are different and take some measures. Therefore, the sheet jams and displacement of image formation can be prevented when images are formed on both front and rear sides.

JP-A-6-56356 discloses an image forming apparatus that senses the position of the first width regulation mechanism with a position detection sensor and electrically changes the position of the second width regulation mechanism with an electric motor or the like. The image forming apparatus has a configuration different from that of the image forming apparatus of the invention including the link mechanism for mechanically changing the position of the second width regulation mechanism. Further, in the image forming apparatus of the invention, the motion is more reliable and less expensive because of mechanical interlocking compared to the case of electrical interlocking. Furthermore, in the image forming apparatus of the invention, it is not necessary to supply power to change the position of the second width regulation mechanism, and thus, when the image forming apparatus is powered ON, the positional adjustment between the first width regulation mechanism and the second width regulation mechanism is not required as an initial operation.

The invention is applicable to an image forming apparatus.

The invetion claimed is:

1. An image forming apparatus comprising:

a housing;

a sheet feed cassette that includes a sheet holding chamber for holding stacked sheets and a first width regulation mechanism provided within the sheet holding chamber and configured to be movable with a center of an image formation range of the image forming unit as a reference position, the sheet feed cassette being removably installed within the housing;

an image forming unit provided within the housing for performing image formation on the sheet to be transported;

a reverse transport mechanism that includes a second width regulation mechanism movable in the width direction, the reverse transport mechanism being provided within the housing for turning over the sheet that has passed through the image forming unit and transporting the sheet to the image forming unit again; and a link mechanism configured to couple the first width regulation mechanism and the second width regulation mechanism for mechanically changing a position of the second width regulation mechanism in association with position change of the first width regulation mechanism, wherein the link mechanism includes:

an output part provided in the sheet feed cassette and having a position or attitude changing in association with position change of the first width regulation mechanism; and an input part provided in the reverse transport mechanism for contacting the output part when the sheet feed cassette is pushed into the housing and changing the position of the second width regulation mechanism in association with the position or attitude of the output part.

2. The image forming apparatus according to claim 1, wherein the reverse transport mechanism has a reverse guide part that turns over the sheet that has passed through the image forming unit and a retransport tray that transports the reversed sheet to the image forming unit again, and the retransport tray and the second width regulation mechanism are provided at the upper surface side of the sheet feed cassette.

3. The image forming apparatus according to claim 1, wherein the reverse transport mechanism has a reverse guide part that turns over the sheet that has passed through the image forming unit and a retransport tray that transports the reversed sheet to the image forming unit again, the retransport tray is provided below the sheet feed cassette, the first width regulation mechanism, the second width regulation mechanism, and the link mechanism are provided at the lower surface side of the sheet feed cassette.

4. The image forming apparatus according to claim 3, wherein the first width regulation mechanism and the second width regulation mechanism have guide plates, rack portions and gears, and the link mechanism includes:

a connecting member that connects the guide plate of the first width regulation mechanism and the guide plate of the second width regulation mechanism; and a timing belt connecting the gear of the first width regulation mechanism and the gear of the second width regulation mechanism.

5. The image forming apparatus according to claim 3, wherein the retransport tray is configured to be detachable from the housing.

6. The image forming apparatus according to claim 1, wherein the reverse transport mechanism has a reverse guide part that turns over the sheet that has passed through the image forming unit and a retransport tray that transports the reversed sheet to the image forming unit again, and the retransport tray and the second width regulation mechanism are provided at the lower surface side of the sheet feed cassette.

7. The image forming apparatus according to claim 6, wherein the retransport tray is configured to be detachable from the housing.

8. An image forming apparatus comprising:

a housing;

a sheet feed cassette that includes a sheet holding chamber for holding stacked sheets and a first width regulation mechanism provided within the sheet holding chamber and configured to be movable with a center of an image formation range of the image forming unit as a reference position, the sheet feed cassette being removably installed within the housing;

an image forming unit provided within the housing for performing image formation on the sheet to be transported;

a reverse transport mechanism that includes a second width regulation mechanism movable in the width direction, the reverse transport mechanism being provided within the housing for turning over the sheet that has passed through the image forming unit and transporting the sheet to the image forming unit again; and a link mechanism configured to couple the first width regulation mechanism and the second width regulation mechanism for mechanically changing a position of the second width regulation mechanism in association with position change of the first width regulation mechanism, wherein the link mechanism includes:

an output part provided in the sheet feed cassette and having a position or attitude changing in association with position change of the first width regulation mechanism; and an input part provided in the reverse transport mechanism for contacting the output part when the sheet feed cassette is pushed into the housing and changing the position of the second width regulation mechanism in association with the position or attitude of the output part, wherein the reverse transport mechanism has a reverse guide part that turns over the sheet that has passed through the image forming unit and a retransport tray that transports the reversed sheet to the image forming unit again, wherein the retransport tray is provided below the sheet feed cassette, wherein the first width regulation mechanism and the output part are provided at the lower surface side of the sheet feed cassette, and wherein the input part and the second width regulation mechanism are provided at the upper surface side of the retransfer tray.

9. The image forming apparatus according to claim 8, wherein the output part includes an output part main body provided movably in the width direction at the lower surface of the sheet feed cassette, and a transmitting member extending in an anteroposterior direction at the lower surface of the sheet feed cassette and having one end that engages with the first width regulation mechanism, a center provided swingable within a horizontal plane, and the other end that engages with the output part main body, and the input part includes a swing member having a center provided swingable within a horizontal plane at the upper surface of the retransport tray and moved by the output part main body, a sliding portion provided movable in the width direction at the upper surface of the retransport tray and engaging with the second width regulation mechanism, and a transmitting member extending in an anteroposterior direction at the upper surface of the retransport tray and having one end that engages with the swing member and the other end that engages with the sliding portion.

10. The image forming apparatus according to claim 2, wherein the retransport tray is configured to be detachable from the housing.

* * * * *